United States Patent [19]

Chan et al.

[11] 4,274,615

[45] Jun. 23, 1981

[54] ATTACHMENT CLAMP FOR LIGHTING FIXTURE

[75] Inventors: Kingsley Chan, Rutherford; Neil Russo, Howell, both of N.J.

[73] Assignee: Lightolier Incorporated, Jersey City, N.J.

[21] Appl. No.: 56,030

[22] Filed: Jul. 9, 1979

[51] Int. Cl.[3] ..... B42F 13/00

[52] U.S. Cl. ..... 248/343; 362/365

[58] Field of Search ..... 248/205 R, 342, 343, 248/DIG. 6, 27.1; 52/28, 39; 362/364, 365, 366; 220/3.5, 3.6

[56] References Cited

U.S. PATENT DOCUMENTS

| | | | |
|---|---|---|---|
| 2,334,799 | 11/1943 | Thompson | 220/3.6 |
| 3,158,329 | 11/1964 | Wince | 362/365 X |
| 3,590,137 | 6/1971 | Librandi | 220/3.6 |
| 3,683,173 | 8/1972 | Guth | 362/364 X |
| 3,872,296 | 3/1975 | Cohen | 248/343 X |
| 4,048,491 | 9/1977 | Wessman | 248/343 X |
| 4,120,473 | 10/1978 | Suk | 248/DIG. 6 |

FOREIGN PATENT DOCUMENTS

| | | | |
|---|---|---|---|
| 249102 | 5/1963 | Australia | 362/365 |
| 613066 | 11/1960 | Italy | 362/365 |

*Primary Examiner*—J. Franklin Foss

*Attorney, Agent, or Firm*—Arthur B. Colvin

[57] ABSTRACT

The present invention relates to an attachment clamp adapted to be mounted to a ceiling, such as a dry wall or acoustical tile ceiling, for structurally supporting a lighting fixture to the ceiling. The attachment clamp, which is formed of an integral resilient metal blank and a threaded adjustment member includes a foot portion adapted to be braced against the upper surface of the ceiling and a locking finger adapted to underlie the ceiling in spaced parallel relation to the foot portion, the threaded adjustment member being operable variably to space the foot and finger to clamp a thickness of ceiling between the two noted components.

5 Claims, 5 Drawing Figures

ATTACHMENT CLAMP FOR LIGHTING FIXTURE

BACKGROUND OF THE INVENTION

1. Field of the Invention

The present invention relates to the electric lighting field and more particularly pertains to a clamp member adapted to be connected to a sheet ceiling, such as a dry wall or acoustical tile ceiling, for enabling a structural connection to be effected between a lighting fixture and the ceiling.

2. The Prior Art

Numerous mechanisms have been suggested for emplacing lighting fixtures in a ceiling. In a typical installation lighting fixtures are structurally mounted in desired positions to joists or other structural components of a building prior to installation of the ceiling. When the ceiling is installed it is necessary to form cutouts in the ceiling tiles or wall board which will coincide, after installation, with the already positioned fixtures.

In many instances it may be desirable to install lighting fixtures in an already existing ceiling. In such cases it is impossible, without substantial damage to the ceiling, to employ normal hanger mechanisms connecting lighting fixtures with the building structure.

In other circumstances, for instance where false ceilings are installed a substantial distance below the joists or like building structures, as on a depending grid or the like, spacing requirements preclude the use of standard hanger fixtures.

SUMMARY OF THE INVENTION

The present invention may be summarized as directed to a clamp device adapted to be supported directly on a sheet ceiling, such as a dry wall, plaster, or acoustical tile ceiling. After emplacement of two or more clamps in a predetermined pattern or spacing, a conventional lighting fixture may be connected directly to the clamps, whereby the fixture will be structurally supported by the ceiling, providing a great degree of latitude in locating the fixtures.

The invention more particularly is directed to a clamp which may be readily applied to the sheet material of the ceiling, the clamp being conveniently attached by a worker having access to the space above the ceiling through an aperture in which the lighting fixture is to be mounted.

The clamp, which is formed of an integral blank of resilient metallic material, includes an upstanding body portion having spaced legs terminating in a horizontally directed foot or feet adapted to engage the upper surface of the ceiling surrounding the fixture aperture.

From the upper end of the body portion there extend upper and lower branches joined by an arcuate connector portion, the distal end of the lower branch including a spanner portion extending outwardly through the space between the legs and downwardly, the spanner portion terminating in a finger disposed in parallel spaced relation to the foot engaging the upper surface of the ceiling.

A threaded adjustment member extends between the branches, enabling the branches to be variably spaced, thereby also variably spacing the foot and finger, whereby the clamp may be adjusted for clamping engagement with ceilings of a variety of thicknesses.

Accordingly, it is an object of the invention to provide an inexpensive and readily applied retainer clamp for supporting lighting fixtures directly to sheet material form a ceiling.

A further object of the invention is the provision of a clamp of the type described wherein the principal components are formed of a unitary blank of resilient metal.

Still a further object of the invention is the provision of a device of the type described wherein attachment of the clamp to a ceiling may be readily effected through the operation of a single adjustment member or means.

Still a further object of the invention is the provision of a clamp of the type described which is of simple and inexpensive construction.

To attain these objects and such further objects as may appear herein or be hereinafter pointed out, reference is made to the accompanying drawings, forming a part hereof, in which.

Figure 1:
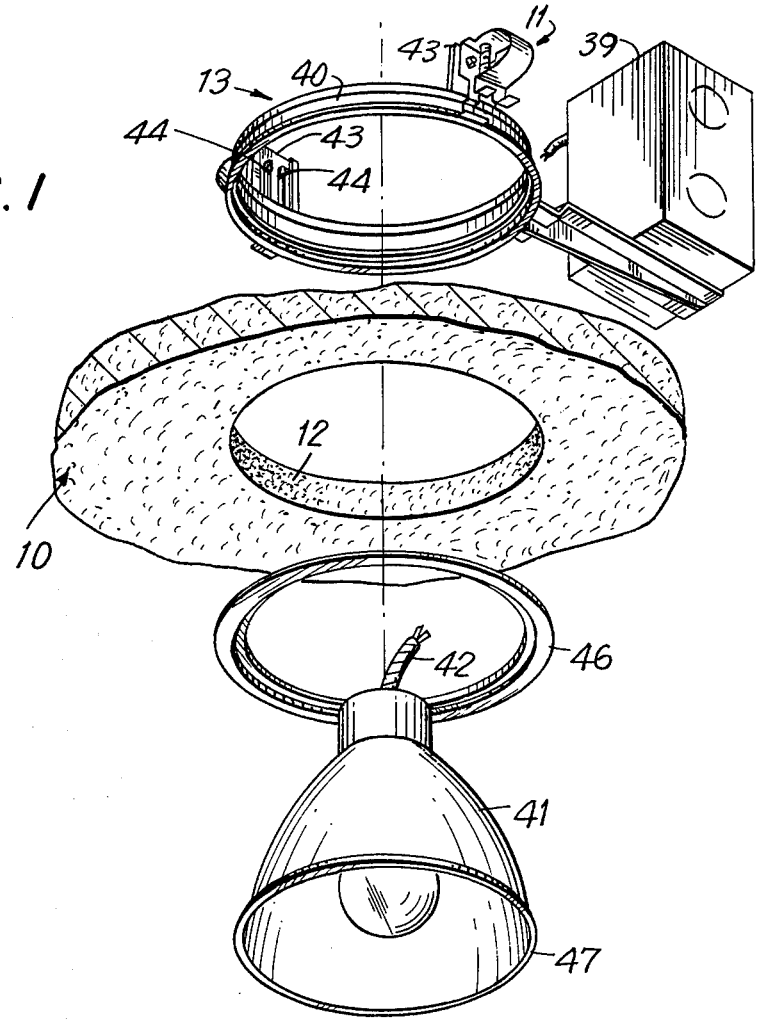
FIG. 1 is a fragmentary exploded perspective view of the components of a lighting fixture illustrating the manner of connection and relationship to a typical ceiling.
Figure 2:
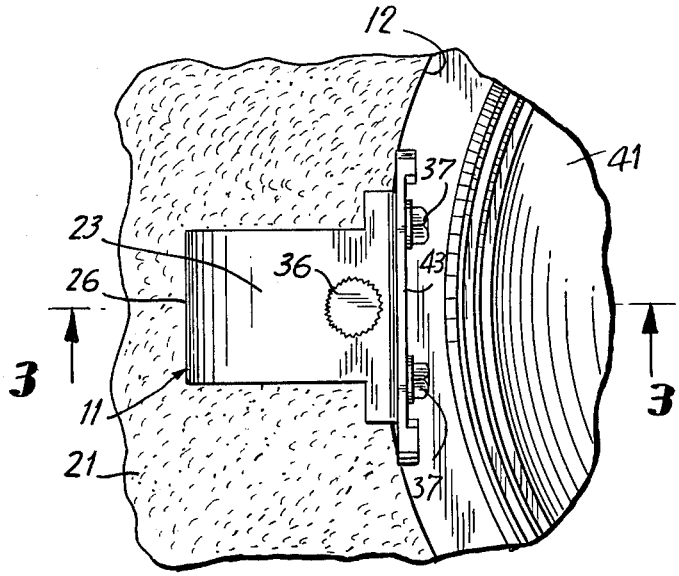
FIG. 2 is a fragmentary top plan view of a clamp mounted to a ceiling and supporting a lighting fixture.

Referring now to the drawings, there is shown illustratively in FIG. 1 a section of a typical ceiling formed of sheet material 10, which may be of the type generally known as dry wall or plaster board. Alternatively, the ceiling 10 may be comprised of acoustical tile, such as one foot square or one foot by two foot tiles. It is the function of the clamp 11 of the present invention to be attachable to the components of the ceiling immediately surrounding an aperture 12 formed for the reception of a fixture, thus to provide a secure anchorage for the lighting fixture 13, which is known per se—for instance in accordance with U.S. Pat. No. 4,039,822 of Aug. 2, 1977 to Chan and Russo. Since the clamps 11 may be employed with any of a variety of lighting fixtures, with minor modification to permit connection between the clamp and the particular fixture, the fixture per se will be described only to the extent necessary to understand the interaction with the clamp.

Figure 3:
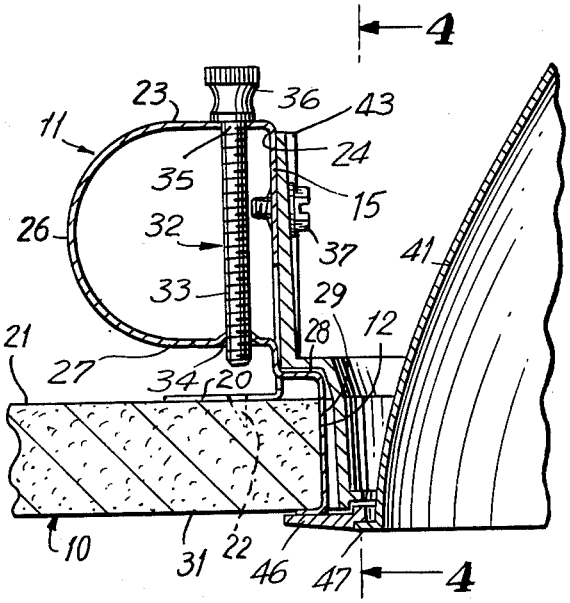
FIG. 3 is a vertical section taken on the line 3—3 of FIG. 2.
Figure 4:
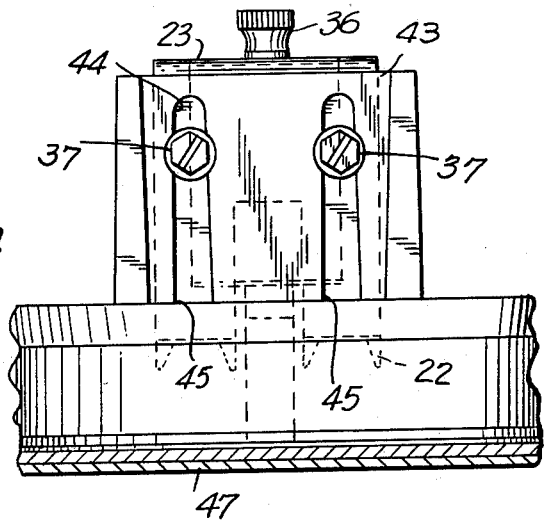
FIG. 4 is a vertical section taken on the line 4—4 of FIG. 3.
Figure 5:
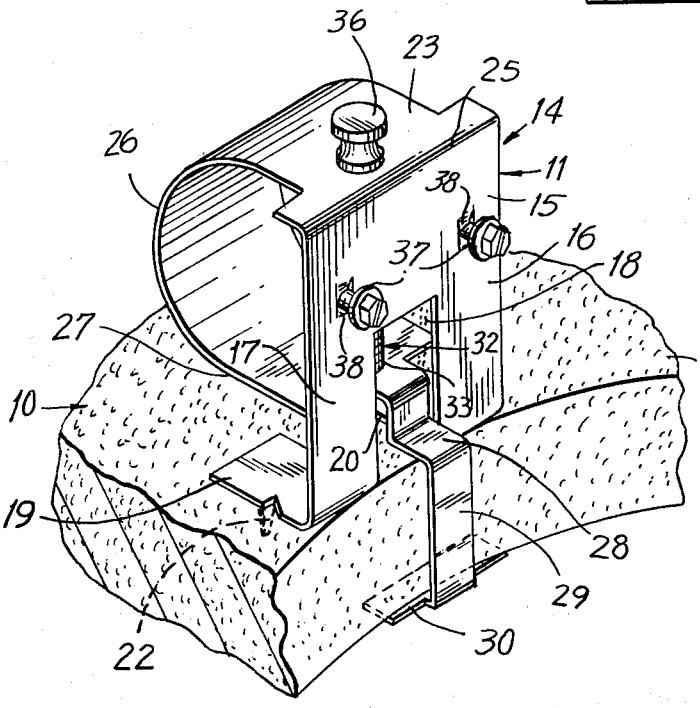
FIG. 5 is a magnified perspective view of a clamp in accordance with the invention secured to a ceiling structure in advance of emplacement of a lighting fixture.

Turning more particularly to FIGS. 3, 4 and 5 wherein details of the clamp are best illustrated, the clamp may comprise an integral resilient metallic blank 14 bent to the configuration hereinafter described, the blank being preferably of a spring steel or metallic material having similar properties. The clamp includes a body portion 15 which will be vertically oriented after installation.

The body portion incorporates a spaced pair of depending legs 16, 17 defining a vertically directed opening or slot 18 therebetween. The lowermost ends of the legs 16, 17 are formed with an integral foot or feet 19, 20 which, in the mounted position, will lie adjacent and brace against the upper surface 21 of the ceiling 10. Optionally but preferably, the feet 19, 20 may include darts or tangs, e.g. 22, struck from the material of the feet for penetration of the ceiling 10 to preclude shifting of the clamp after attachment to the ceiling.

The clamp 11 includes an upper branch 23 extending laterally from the inner face 24 of the body portion 15, the branch 23 being joined to the body portion at a fold line 25.

Forming a continuation of the branch 23 is an arcuate connector portion 26 which is curved and thereafter extends outwardly to define as a further continuation, a lower branch 27, the lower branch 27 being disposed in parallel spaced relation to the foot or feet 19, 20—see FIG. 3.

A narrow stepped spanner portion 28 extends outwardly from the lower branch 27, the spanner portion projecting outwardly through the space 18 defined between legs 16, 17. The spanner portion clamp member 28 includes a dependent reach portion 29 which lies adjacent the aperture defined in the ceiling, the reach portion terminating in a locking finger 30 which extends outwardly in parallel spaced relation to the foot or feet 19, 20.

As will be understood, the clamping action desired is secured by disposing a section of the ceiling between the foot or feet 19, 20 and the locking finger 30, with the noted parts spread sufficiently widely to enable the ceiling to be straddled thereby, and thereafter shifting the parts so that they clampingly engage against the upper and lower surfaces of the ceiling 21 and 31, respectively.

The desired adjustment is effected by a threaded adjustment member or bolt 32 having a threaded shank 33 threadedly engaged in aperture 34 formed in the lower branch 27. The upper end of the shank 33 passes loosely through an aperture 35 formed in the upper branch 23. A knurled adjustment head 36 is formed on the uppermost end of the bolt 32.

Means are provided on the clamp, and more particularly, in the illustrated embodiment, on the body portion 15 thereof, for enabling the lighting fixture 13 to be supported to the housing after emplacement of the clamps on the ceiling. More particularly, a pair of machine screws 37 threadedly engaged in stamped apertures 38 provide a means for connecting the clamps to the lighting fixture.

Briefly, the lighting fixture may comprise a junction box 39 electrically connected to the electrical mains, the box being mounted to a support rim 40. A reflector housing 41 having a bulb socket mounted therein is connected as by an electrical cable 42 to the junction box 39. Friction means (not shown) may be provided on the rim 40 for frictionally engaging and receiving the reflector housing 41. Said frictional means may, for example, take the form shown in the aforesaid U.S. Patent No. 4039,822.

The mounting rim 40 may include two or more adjustable mounting brackets 43 provided with spaced vertical adjustment slots 44, 44, the spacing of the said adjustment slots corresponding to the spacing of the machine screws 37 on the clamps 11.

The manner of attachment of a fixture to a ceiling utilizing the clamp in accordance with the invention will be apparent from the preceding discussion.

Assuming the mains connections to have been first made to the junction box 39, a pair of clamps are secured about the periphery of an aperture 12 cut into the ceiling. Mounting of the clamps is effected by manipulating the adjustment means or bolt 32 so that the spacing of the locking finger 30 from the plane of the feet 19, 20 is greater than the thickness of the material of which the ceiling is formed.

The clamps are secured by shifting the same outwardly to encompass a thickness of the ceiling between the foot or feet and the locking finger and thereafter operating the bolt so as to force the locking finger closer to the feet, clamping a section of the ceiling between the noted parts. A second said clamp is similarly attached to the ceiling in diametrically opposed relation to the first positioned clamp, such as to correspond to the spacing of the brackets 43, 43 of rim 40.

After the clamps have been properly positioned, the rim 40 is lowered such that the open entry ends 45 of the vertically directed slots 44 are fitted over the shank of the bolts 37. The rim is moved downwardly to its desired adjusted position, following which bolts 37 are tightened, locking the rim to the positioned clamps.

Thereafter, the light housing 41 which, during the installation hangs outwardly through the hole in the ceiling, is forced upwardly into frictional engagement with the mounted rim. The annular bezel 46, having an outer diameter greater than the diameter of the cutout 12 and an inner diameter smaller than the diameter of the flange 47 of the reflector, is sandwiched between the flange and the ceiling so as to cover the raw edge of the hole cut into the ceiling for the reception of the fixture.

From the foregoing it will be understood that there is provided a novel clamp assembly adapted to be connected directly to a ceiling, such as a dry wall or acoustical tile ceiling, the emplaced clamp providing anchoring means for the structural support of a lighting fixture or the like. The clamp, which is fabricated principally from a single blank of material, is adjustable to accommodate a wide range of ceiling thicknesses or irregularities and may be readily installed from a position below the ceiling. Connection between the clamp and the frame of the lighting fixture may take a variety of forms.

As will be apparent to those skilled in the art familiarized with the instant disclosure, numerous variations may be made in the structural details of the clamp without departing from the spirit of the present invention. Accordingly, the invention is to be broadly construed within the scope of the appended claims.

Having thus described the invention and illustrated its use, what is claimed as new and is desired to be secured by Letters Patent is:

1. An attachment clamp for securing a lighting fixture to a ceiling of sheet material, such as wall board, acoustical tile or the like, comprising an integral resilient metallic bifurcate body portion including a spaced pair of upstanding legs, a support foot extending from the lowermost end of said legs in a direction perpendicular thereto and projecting to one side of said body portion, an adjustment arch extending to said one side of said body portion in upwardly spaced relation to said foot, said arch including an upper branch extending from the upper end of said body portion, a lower branch and an arcuate connector portion extending between said braches, a clamp portion extending from said lower branch, said clamp portion projecting outwardly through the space between said legs and including a depending spanner portion having a locking finger formed thereon, said finger being disposed to said one side of said body portion in parallel spaced relation to said support foot, and threaded adjustment means extending between said upper and lower branches for variably spacing said branches in accordance with the adjusted position of said threaded means, thereby to shift said locking finger toward and away from said support foot for clamping engagement of a ceiling portion between said foot and finger.

2. An attachment clamp in accordance with claim 1 wherein said branches are normally biased to a spread position whereby said foot is disposed in spaced relation to said finger.

3. An attachment clamp in accordance with claim 2 wherein said body portion includes attachment means adapted to engage the housing of a lighting fixture.

4. Apparatus in accordance with claim 3 wherein said attachment means comprise a pair of transversely spaced-apart machine screw members having head portions projecting to the other side of said body portion.

5. A lighting fixture assembly adapted to be supported from a ceiling of sheet material such as wall board, acoustical tile or the like by direct connection thereto comprising, in combination, a plurality of attachment clamps, each said attachment clamp comprising an integral resilient metallic bifurcate body portion including a spaced pair of upstanding legs, a support foot extending from the lowermost end of said legs in a direction perpendicular thereto and projecting to one side of said body portion, an adjustment arch extending to said one side of said body portion in upwardly spaced relation to said foot, said arch including an upper branch extending from the upper end of said body portion, a lower branch and an arcuate connector portion extending between said branches, a clamp portion extending from said lower branch, said clamp portion projecting outwardly through the space between said legs and including a depending spanner portion having a locking finger formed thereon, said finger being disposed to said one side of said body portion in parallel spaced relation to said support foot, and threaded adjustment means extending between said upper and lower branches for variably spacing said branches in accordance with the adjusted position of said threaded means, thereby to shift said locking finger toward and away from said support foot for clamping engagement of a ceiling portion between said foot and finger, a fixture housing portion, and complemental means on said housing portion and said body portion of said attachment clamps for connecting said clamps and housing portion.

* * * * *